US005803717A

United States Patent [19]

Iversen et al.

[11] Patent Number: 5,803,717

[45] Date of Patent: Sep. 8, 1998

[54] REFRIGERANT COMPRESSOR ARRANGEMENT

[75] Inventors: Frank Holm Iversen, Padborg; Svend Erik Outzen; Hans Christian Andersen, both of Sønderborg, all of Denmark

[73] Assignee: Danfoss Compressors GmbH, Flensburg, Germany

[21] Appl. No.: 718,478

[22] PCT Filed: Mar. 27, 1995

[86] PCT No.: PCT/DK95/00129

§ 371 Date: Jan. 3, 1997

§ 102(e) Date: Jan. 3, 1997

[87] PCT Pub. No.: WO95/27141

PCT Pub. Date: Oct. 12, 1995

[30] Foreign Application Priority Data

Mar. 30, 1994 [DE] Germany ..... 44 11 191.6

[51] Int. Cl.[6] ..... F04B 39/00

[52] U.S. Cl. ..... 417/312; 417/902; 285/302; 62/296

[58] Field of Search ..... 417/312, 902; 285/298, 302; 62/296

[56] References Cited

U.S. PATENT DOCUMENTS

| | | | |
|---|---|---|---|
| 3,685,117 | 8/1972 | Wing et al. | 29/203 P |
| 4,160,625 | 7/1979 | Dyhr et al. | 417/363 |
| 5,462,311 | 10/1995 | Cipolla | 285/298 |

FOREIGN PATENT DOCUMENTS

| | | | |
|---|---|---|---|
| 1925477 | 12/1970 | Germany | 285/302 |

*Primary Examiner*—Timothy Thorpe
*Assistant Examiner*—Cheryl J. Tyler
*Attorney, Agent, or Firm*—Lee, Mann, Smith, McWilliams, Sweeney & Ohlson

[57] ABSTRACT

A refrigerant compressor arrangement is disclosed, having a compressor which is arranged in a housing and which has a suction connection, the housing being provided with a suction connector which is joined to the suction connection by way of a suction channel. In such an arrangement, it is desirable to increase the opportunity of the compressor to move, that is, to reduce noise, without at the same time having to accept a deterioration in efficiency. To that end, at its housing end the suction channel is in the form of a telescope tube which is capable of being telescoped into the suction connector.

15 Claims, 1 Drawing Sheet

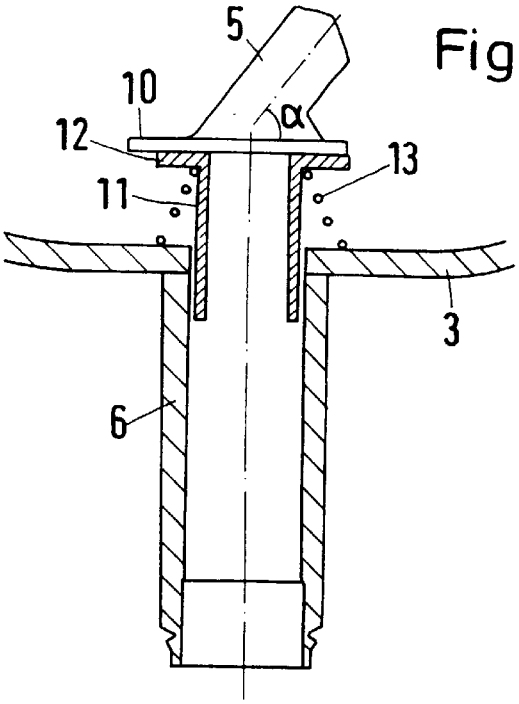
Fig.2
Fig.1
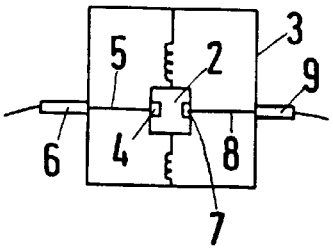
Fig.3
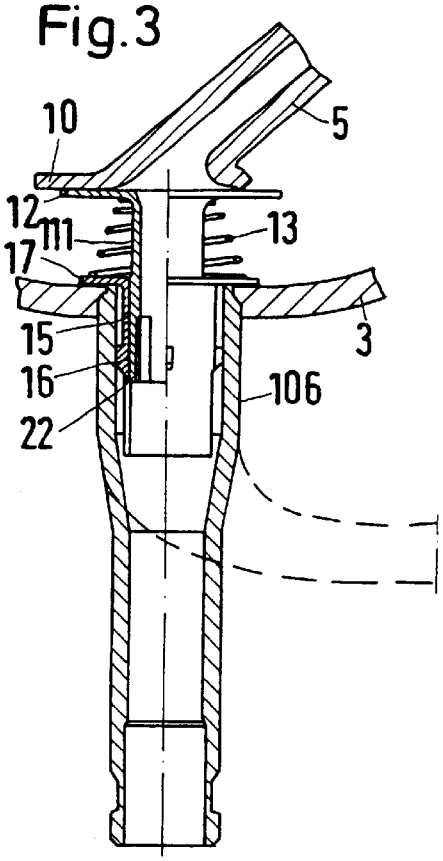
Fig.4
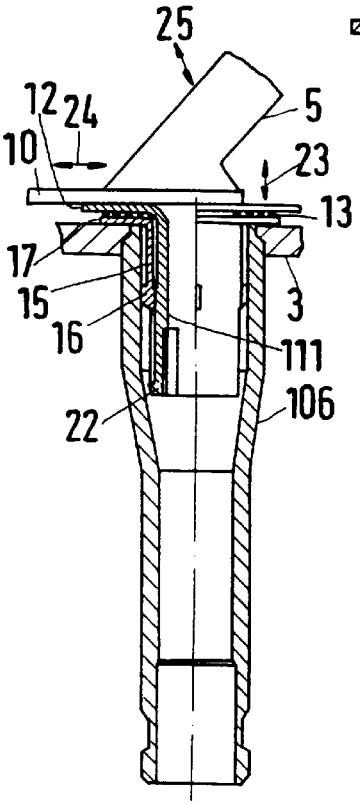
Fig.5
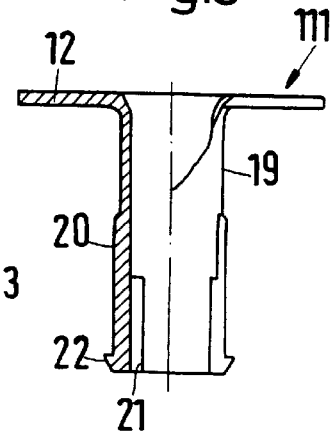
Fig.6
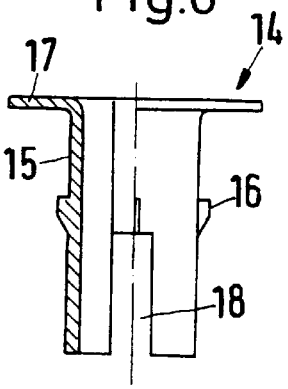

REFRIGERANT COMPRESSOR ARRANGEMENT

BACKGROUND OF THE INVENTION

The invention relates to a refrigerant compressor arrangement having a compressor which is arranged in a housing and has a suction connection, the housing being provided with a suction connector which is joined to the suction connection by way of a suction channel.

In a known arrangement of that kind (U.S. Pat. No. 4,969,804), the suction channel is provided in the region of both ends with an O-ring seal and is fixedly inserted in the suction connector and the suction connection respectively. In the suction connection of the compressor there is a slight axial play. However, significant opportunity for the compressor to move with respect to the suction channel is non-existent. Vibrations of the compressor will consequently be transferred to the housing. As a result, undesirable noise occurs, particularly at the start and the end of the compressor operation.

DE 36 33 487 A1 discloses a compressor system in which a tubular sealing element is inserted in the suction connector. At the other end, the sealing element has a conical widened portion which on assembly positions itself against the compressor housing in such a way that the edge of the widened portion surrounds the suction connection. The widened portion is provided with slots. This makes the widened portion resilient in some respects, that is to say, vibrations or oscillations of the compressor can be absorbed to a certain extent. But the slots lead to considerable permanent leakage, so that refrigerant enters the housing, that is to say, the capsule surrounding the compressor, and heats up there. Although the compressor is also able to take in and compress heated refrigerant, in doing so its efficiency decreases.

SUMMARY OF THE INVENTION

The invention is based on the problem of providing a compressor arrangement in which the compressor is able to oscillate relatively freely in the housing without appreciable reduction in efficiency.

In a refrigerant compressor arrangement of the kind mentioned at the outset, this problem is solved in that, at its housing end, the suction channel is in the form of a telescope tube which is capable of being telescoped into the suction connector.

This makes relatively large compressor movements possible. The telescoping arrangement of the telescope tube in the suction connector allows movements of relatively large amplitude, without openings forming in the suction channel. On the contrary, the movements are made possible by the telescope tube sliding to and fro in the suction connector. Furthermore, the flow of refrigerant is then predominantly not in contact with the inner wall of the housing end of the suction connector. The latter is heated by the compressor housing, particularly the first 2–3 cm. If this contact, and consequently dissipation of heat to the refrigerant, can now be avoided, the refrigerant remains colder and the efficiency of the compressor increases.

The suction channel is preferably interrupted at the end of the telescope tube and has there a suction flange against which a telescope tube flange joined to the telescope tube lies. In this construction, the part of the suction channel which must be able to effect the telescoping movement in the suction connector can be suitably designed without the entire suction channel needing to be of corresponding construction. Construction can consequently be kept simple and inexpensive. A satisfactory join between telescope tube and suction channel is ensured by means of the two flanges.

The suction flange and the telescope tube flange are preferably displaceable relative to one another by a predetermined distance before the suction channel emerges into the inside of the housing. The join between telescope tube and suction channel therefore does not even need to be rigid. On the contrary, displacements can be allowed. Although the telescopic guidance of the suction channel in the suction connector allows the compressor to oscillate not only in one direction but to a certain extent allows oscillations also in the other direction, the displaceability of the two flanges relative to one another now provides a definite opportunity for the compressor to perform oscillations in virtually all directions without these being transferred through a rigid coupling by way of the suction channel to the housing. At the same time, during these oscillations the suction channel always remains adequately sealed, so that during operation of the compressor no refrigerant, or virtually no refrigerant, is able to escape into the inside of the housing. The efficiency of the compressor can thus be maintained at a relatively high level.

A device generating a bias force which applies a force on the telescope tube in a direction out of the suction connector, is preferably provided. In this construction, the two flanges need not even be joined to one another any more. On the contrary, the device generating the bias force ensures that the telescope tube flange is pressed against the suction flange with the force generated. This bias force is sufficient to create an adequately sealed joint between the telescope tube and the suction channel. Relatively small gaps may indeed occur, but since the pressures in the suction channel and in the inside of the housing are virtually the same, no appreciable amounts of refrigerant are able to penetrate through these small leaks to the inside of the housing. Also, the gaps occur in operation only for a very brief time. For the rest, the join obtained by the flanges bearing against one another is sufficiently tight to prevent refrigerant escaping.

The device generating the bias force is preferably in the form of a spring. The spring is a structural part which, after its installation, generates the bias force virtually permanently. Introduction of energy or force from the outside it therefore not necessary.

The spring is preferably arranged between the telescope tube flange and the housing. There is thus an adequately large bearing surface available for the spring to bear on the telescope tube. The flow path for the refrigerant is not adversely affected by the spring.

The spring is preferably is the form of a helical spring of conical form, and in its compressed state forms essentially a spiral. This provides the telescope tube with a relatively large degree of mobility despite the spring. The telescope tube can be inserted in the suction connector to such an extent that only the thickness of the spring wire remains between the telescope tube flange and the housing. That is to say, the individual turns or coils of the spring position themselves adjacent one another in this form of the spring. If an ordinary helical spring were to be used, the spring would have a greater minimum height.

The suction flange preferably forms an acute angle with the suction channel. The suction flange does not therefore run at right angles to the suction channel. In most movements of the compressor, not only will forces that push the telescope tube into or withdraw it from the suction connector therefore occur, but also forces which lead to displacement of the two flanges relative to one another. Any forceful action on the telescope tube that could lead to the risk of jamming is therefore kept very small.

The telescope tube is preferably guided in a tube holder fixed in the suction connector. This ensures that the telescope tube can be guided with a relatively good seal with respect to the suction connector despite its axial movability. Only the inner surface of the tube holder requires to be matched herein to the outer surface of the telescope tube. It is not necessary to machine the suction connector correspondingly accurately. This reduces manufacturing costs and increases the reliability of the arrangement in operation.

On its outside the tube holder preferably has projections by means of which it lies against the inner wall of the suction connector. This construction has two advantages. Firstly, transfer of heat between the suction connector and the tube holder is limited to the projections. When a heat-conduction path of small cross-section is provided, only a small amount of heat can be transferred to the tube holder and thus by way of the telescope tube to the refrigerant, so that the compressor is able to operate with improved efficiency. Secondly, the suction connector only need be constructed in such a way that it exerts adequate retaining force on the tube holder by way of the projections. No further demands are made of the form of the suction connector. In particular, it is not necessary for it to be, for example, as exactly circular as possible.

It is also preferred for the telescope tube to have runners on its outside with which is it guided in the tube holder. With this construction, even a certain deformation of the tube holder as it is inserted in the suction connector can be tolerated. When the telescope tube is guided by way of the said runners in the tube holder, it is basically only necessary for the tube holder to conform to the necessary dimensions in the region of these runners. Elsewhere, it can be deformed. This in turn facilitates assembly, because one can work more quickly and one does not need to pay so much attention to the exact fitting form of the tube holder. Heating of the telescope tube is additionally limited.

The tube holder preferably has a holder flange which lies from the inside adjacent to the housing. The tube holder is thus introduced from the inside of the housing into the suction connector and then lies with its holder flange against the housing. The suction connector is thus sealed with respect to the inside of the housing. The holder flange in that case lies in face-to-face contact with the inner side of the housing. If a spring is used, it can then be advantageous for the spring to be arranged between the holder flange and the telescope tube flange. The holder flange is then pressed by the force of the spring additionally against the inner side of the housing. The transmission of vibrations, and thus of noise, is additionally somewhat reduced.

In the region of its leading end, which is located in the suction connector, the telescope tube advantageously, has a stop member which bears against the tube holder on movement of the telescope tube into the inside of the housing and limits this movement. The movement of the telescope tube is thus restricted at one end by the stop member and at the other end by the telescope tube flange. Even when the compressor makes relatively large movements, such as those which may occur during transport of the compressor arrangement, the telescope tube remains in position without accidentally sliding out of the suction connector.

The telescope tube is preferably slotted in the region of its leading end. The leading end consequently has a certain resilience, so that the stop member is able to yield inwards as the telescope tube is introduced into the tube holder. As soon as the stop member has passed the tube holder, it is able to snap outwards. It then locks behind the tube holder.

It is also preferred for the tube holder to have at its leading end remote from the holder flange an axially extending recess, in which the stop member is arranged. The stop member is thus in a way guided axially. This measure makes assembly somewhat simpler. The telescope tube, the tube holder and the spring can be put together outside the housing and then installed as a unit.

It is also preferred for the suction connector to have a enlarged diameter and/or a greater wall thickness in its region receiving the telescope tube. The flexural strength of the suction connector is thus increased in this region. If the suction connector is bent, the bending will take place outside this region, so that the mobility of the telescope tube in the suction connector is not affected thereby.

The invention is described hereinafter with reference to preferred embodiments in conjunction with the drawings, in which

BRIEF DESCRIPTION OF THE DRAWINGS

FIG. 1 is a diagrammatic view of a refrigerant compressor arrangement,

FIG. 2 shows a first embodiment of a suction connection arrangement for a refrigerant compressor, FIG. 3 shows a second embodiment with the suction connector and suction channel in a first position, FIG. 4 shows, partially in vertical section, the construction of FIG. 3 with the suction connector and suction channel in a second position, FIG. 5 shows a telescope tube, partially in vertical section, and FIG. 6 shows a tube holder, partially in vertical section.

DESCRIPTION OF EXAMPLES EMBODYING THE BEST MODE OF THE INVENTION

FIG. 1 is a diagrammatic view of a refrigerant compressor arrangement 1 having a compressor 2 which is resiliently suspended in a housing 3. The compressor 2 is connected in a manner not illustrated to a motor which drives it. The compressor 2 has a suction connection 4, which is connected by way of a suction channel 5 to a suction connector 6. Similarly, the compressor has a pressure connection 7 which is connected to a pressure connector 9 by way of a pressure line 8.

FIG. 2 shows in more detail the connection of the suction channel 5 to the suction connector 6. The suction channel has a suction flange 10 which is arranged at an acute angle a to the suction channel 5. A telescope tube 11 bears against the suction flange 10 by way of a telescope tube flange 12. The telescope tube 11 continues the suction channel into the suction connector 6. The telescope tube 11 is introduced into the suction connector 6 and is capable of being telescoped therein. Between the telescope tube flange 12 and the housing 3 there is arranged a helical compression spring 13 which is conically wound. When the spring is fully compressed, the individual turns of the spring therefore lie in one plane axially next to one another.

The helical compression spring 13 presses the telescope tube 11 with the telescope tube flange 12 against the suction flange 10. The suction flange 10 is in its turn loaded by way of the suction channel 5 from the compressor. These two counteracting forces are sufficient to hold the two flanges 10, 12 in position against one another. A certain mutual displaceability of the two flanges is nevertheless allowed. This displaceability can take place provided that the suction channel 5 is not opened by the displacement. Therefore, when the compressor 2 moves in the housing 3, on the one hand the telescope tube 11 is pushed to a greater or lesser extent into the suction connector 6, and on the other hand the suction flange 10 is also displaced laterally with respect to the telescope tube flange 12. A slight tilting movement of the suction channel 5 can even be allowed. This tilting movement can partly be accommodated by the mounting of the telescope tube 11 in the suction connector 6. Should the tilting become greater, the suction flange 10 may, however, lift away from the telescope tube flange 12 and a small leak may occur. This leak occurs only briefly and is therefore of no further significance.

In a manner not illustrated, the suction channel 5 need not be directly connected to the compressor 2. On the contrary, a suction sound absorber can additionally be arranged in the course of the suction channel 5. Alternatively, the suction sound absorber can be arranged in front of the suction connector 6 if this is necessary.

FIGS. 3 and 4 show a different construction of the connection of the suction channel to the connection connector, in which identical parts have been provided with the same reference numbers. Corresponding parts have been given reference numbers increased by 100.

The telescope tube 111 is now no longer directly inserted in the suction connector 106. On the contrary, first of all a tube holder 14, illustrated on an enlarged scale in FIG. 6, has been introduced into the suction connector 106. The tube holder 14 has a shank 15 with projections 16 on its outside, by means of which it is fixed inside the suction connector 106. At the end at which the tube holder 14 projects from the suction connector 106, it has a holder flange 17 with which it lies adjacent to the inside of the housing 3. The holder flange 17 ensures that the tube holder 14 is not pushed into the suction connector 106 during assembly or in operation. At its end remote from the holder flange 17, the leading end, the tube holder 14 has a recess 18, which in the simplest case is in the form of a slot, starting from the leading end. By means of this slot, the tube holder 14 is imparted a certain flexibility at this end. It is likewise possible, of course, to provide several slots distributed in the circumferential direction.

Retention of the tube holder 14 in the suction connector 106 by means of the projections 16 means that no great care need be taken in the machining of the suction connector 106. Moreover, these projections 16 have the advantage of a somewhat reduced heat transfer from suction connector 106 to the tube holder 14.

The telescope tube 111 likewise has a shank 19 which is provided on its outside with runners 20. Using the runners 20, the telescope tube 111 is able to slide inside the tube holder 14. At the end of the shank 19 remote from the telescope tube flange 12, the leading end, the shank 19 is likewise slotted, that is to say, it has slots 21 which render the leading end likewise flexible. At the leading end, the runners 20 have radially outwardly directed projections 22 which can be bevelled towards the leading end. If the telescope tube 111 is now introduced into the tube holder 14, the leading end of the shank 19 can be compressed somewhat on account of the slots 21, so that the projections 22 pass through the tube holder 14. As soon as they have passed through the tube holder 14 they snap outwards. They therefore form a stop which bears against the tube holder 14 on movement of the telescope tube 111 out of the suction connector 106, and limits the movement. Even with relatively large movements of the suction channel, such as those which may occur not in operation but during transport of the refrigerant compressor arrangement 1, the telescope tube 111 thus remains reliably housed in the suction connector 106. The projections 22 can be guided in the recesses 18. In this manner, the telescope tube 111 is guided over a relatively large region of its axial length, regardless of its position, yet a stop is provided which leads to limitation of movement. In operation, the combination of tube holder 14 and telescope tube 111 constitutes a certain insulation length, so that the refrigerant flows in the telescope tube 111 the last centimetres before entry into the housing, thus, the refrigerant no longer has contact with the wall of the suction connector 106. Contact of the telescope tube 111 with the suction connector 106, or rather the tube holder 14, is also limited, so that there is only a very slight transfer of heat to the refrigerant.

FIG. 3 shows the connection of suction channel 5 and suction connector 106 in a position in which the suction flange 10 is spaced relatively far from the wall of the housing 3. FIG. 4 shows the other extreme position, in which the suction flange 10 is virtually in engagement with the wall of the housing 3. One can see here that the individual turns or coils of the spring 13 have positioned themselves next to one another.

The opportunities of the suction tube 5 for movement with respect to the suction connector 106 are illustrated by three arrows 23, 24, 25; 23 reproduces the telescoping movement of the telescope tube 111, 24 reproduces the possible movement between the suction flange 10 and the telescope tube flange 12, and the last arrow is intended to represent a tilting movement which will occur extremely rarely in operation but more frequently during transport of the refrigerant compressor arrangement. The construction illustrated allows the suction tube to lift during tilting in the direction of the arrow 25 without the parts illustrated being damaged.

In many cases the flanges will not even lift away from one another because the tube holder 14 can be mounted so loosely in the suction connector 106 that it is able to a certain extent to adapt to a tilting movement.

When a construction with a tube holder 14 is used, the helical compression spring 13 is best arranged between the holder flange 17 and the telescope tube flange 12. The helical compression spring 13 then serves at the same time to press the tube holder 14 into the suction connector 106.

Manufacture is relatively simple. For example, the tube holder 14, spring 13 and telescope tube 111 can be assembled and then inserted in the suction connector 106. Before installing the compressor, the arrangement is brought into the position illustrated in FIG. 4. After installation, the spring 13 is relieved of pressure and the telescope tube flange 13 bears against the suction flange 10.

The suction flange 10 and the telescope tube flange 12 can, of course, also be held against one another in a different way.

The suction connector 106 has an enlarged diameter and/or a greater wall thickness in the region in which the telescope tube 111 is received. This gives rise to a greater flexural strength, so that as the suction connector 106 bends, as shown, for example, by broken lines, deformation does not take place in the region in which the telescope tube 111 is displaceable. This simple measure does not impair manipulation, despite the use of the telescope tube 111.

The great mobility of the compressor 2 rendered possible by the connection shown means that merely for the purpose of suspending the compressor 2 in the housing 3 relatively few springs can be used. Noise transfer to the housing 3 is further reduced.

We claim:

1. A refrigerant compressor arrangement having a compressor arranged in a housing, the compressor having a suction connection, the housing being provided with a suction connector which is joined to the suction connection by way of a suction channel, the suction channel including a telescope tube located at a housing end of the suction channel and formed to be telescoped into the suction connector, and including means urging the telescope tube toward the suction channel and in a direction out of the suction connector.

2. An arrangement according to claim 1, in which the suction connector has at least one of an enlarged diameter and a greater wall thickness in its region receiving the telescope tube.

3. An arrangement according to claim 1, in which the suction channel terminates at the telescope tube and has a suction flange bearing against a telescope tube flange joined to the telescope tube lies.

4. An arrangement according to claim 3, in which the suction flange and the telescope tube flange are laterally displaceable relative to one another.

5. An arrangement according to claim 1, in which the urging means is a spring.

6. An arrangement according to claim 5, in which the spring is arranged between a tube flange of the telescope tube and the housing.

7. An arrangement according to claim 5, in which the spring is a helical spring of conical form and when compressed forms essentially a spiral.

8. An arrangement according to claim 5, in which the suction flange forms an acute angle with the suction channel.

9. An arrangement according to claim 1, in which the telescope tube is guided in a tube holder fixed in the suction connector.

10. An arrangement according to claim 9, in that the tube holder has on its outside projections which bear against the inner wall of the suction connector.

11. An arrangement according to claim 9, in which the telescope tube has runners on its outside to guide the telescope tube in the tube holder.

12. An arrangement according to claim 9, in which the tube holder has a holder flange which lies adjacent to the housing.

13. An arrangement according to claim 9, in which the telescope tube has a leading end, located in the suction connector, the telescope tube having a stop member which bears against the tube holder on movement of the telescope tube into the housing and limits this movement.

14. An arrangement according to claim 13, in which the telescope tube is slotted in the region of its leading end.

15. An arrangement according to claim 13, in the tube holder has an axially extending recess on its leading end remote from a holder flange of the tube holder, the stop member being arranged in the recess.

* * * * *